United States Patent [19]

Frazier et al.

[11] Patent Number: 4,938,382

[45] Date of Patent: Jul. 3, 1990

[54] DISPENSING CABINET FOR PAPER SHEETS

[75] Inventors: Alan D. Frazier, West Chester; Richard P. Lewis, Oaks, both of Pa.; Richard O. Norman, San Antonio, Tex.

[73] Assignee: Scott Paper Company, Philadelphia, Pa.

[21] Appl. No.: 339,913

[22] Filed: May 22, 1989

Related U.S. Application Data

[63] Continuation of Ser. No. 79,842, Jul. 30, 1987, abandoned.

[51] Int. Cl.[5] ..... B65H 1/00

[52] U.S. Cl. ..... 221/45; 221/62; 221/63; 211/16; 211/50; 312/60

[58] Field of Search ..... 206/449, 556, 494; 221/44, 45, 47, 48, 55, 57, 61, 62, 63, 281–283; 211/16, 50, 51, 45; 312/50, 60, 61

[56] References Cited

U.S. PATENT DOCUMENTS

| | | | |
|---|---|---|---|
| 1,065,112 | 6/1913 | Clarke | 221/63 |
| 1,709,214 | 4/1929 | Griffith et al. | 221/62 |
| 1,944,431 | 1/1934 | Hope et al. | 312/60 |
| 3,208,636 | 9/1965 | Filipowicz | 221/57 |
| 3,381,852 | 5/1968 | Bastian | 221/44 |
| 3,425,595 | 2/1969 | Shapiro | 221/57 |
| 3,777,931 | 12/1973 | Fleming | 221/57 |
| 3,935,965 | 2/1976 | Steven | 221/45 |

*Primary Examiner*—H. Grant Skaggs

*Attorney, Agent, or Firm*—Joseph H. Yamaoka; John W. Kane, Jr.; Mark G. Bocchetti

[57] ABSTRACT

A cabinet for dispensing a sheet of paper from a stack of paper sheets in the cabinet. Means are provided in the cabinet for restricting the length of the stack of paper that can be placed in the cabinet when the cabinet is open. The restricting means is movable to a pressure relieving position when the cabinet is closed.

11 Claims, 6 Drawing Sheets

DISPENSING CABINET FOR PAPER SHEETS

This application is a continuation of application Ser. No. 07/079,782, filed July 30, 1987.

TECHNICAL FIELD

This invention relates generally to a cabinet from which individual sheets of paper can be withdrawn from a stack of the paper product in the cabinet. This invention is specifically directed to a dispensing cabinet that includes means for relieving the pressure on the stack of paper if too much of the paper product is placed into the cabinet.

BACKGROUND ART

One problem with dispensing cabinets for stacked paper products such as folded paper towels, in which one towel is withdrawn from a dispensing slot at the bottom of the cabinet is that the weight of the stack on the bottom towel at the dispensing opening can impede efficient dispensing of the towels when the cabinet is full. A solution to this problem is provided in U.S. Pat. No. 3,381,852 issued to Lehyman J. Bastian, and assigned to Scott Paper Company, the assignee of the subject invention. As disclosed at column 4, line 65 through column 6, line 19 of the Bastian Patent, the weight of the stack of paper towels on the bottommost towel is reduced by controlling the alignment of back wall 15 with the back edge 26 of the dispensing opening 25. Bastian also teaches the use of pressure release means 28 extending into the cabinet from side walls 13 and 14 which liftingly engage the end edges of towels in the stack to carry some of their weight and to partially impede their movement toward the bottom of the dispenser, thereby reducing the pressure on the bottommost towel of the stack.

A problem that has been solved by the dispensing cabinet provided by Bastian or by others occurs when the person responsible for refilling the towel cabinet overfills the cabinet to the extent that a stack of towels is compressed between the top wall and the dispensing throat at the bottom of the cabinet. In this case, the rear wall 15 and the pressure release means 28 of Bastian do not provide any effective relief of pressure on the bottommost towel at the dispensing opening. When a dispensing cabinet is in such an overpacked condition, it may be impossible to withdraw a single, whole paper towel from the cabinet. When the compressive force applied to the bottom sheet against the dispensing opening exceeds the tensile strength of the paper towel, the withdrawal force applied to the bottom sheet by a towel user results in the towel tearing before it can be withdrawn entirely from the dispensing opening. In order to relieve this pressure, it is necessary to tear and remove a number of paper towels from the dispensing cabinet before normal dispensing can occur. These torn towels either have limited use or are not used at all which results in considerable waste.

It is, therefore, one object of this invention to provide a dispensing cabinet for a stack of paper sheets having a first stack restricting length when the cabinet is open and having a second longer stack restricting length when the cabinet is closed.

It is another object of this invention to provide an improved cabinet for dispensing folded paper products such as towels or napkins from a stack in the cabinet.

Another object of this invention is to provide a dispensing cabinet for a stack of paper sheets which includes means for relieving the pressure on a stack of paper sheets that have been compressively inserted into the cabinet.

another object of this invention is to provide automatic pressure relief to a compressed stack of paper sheets that have been inserted into a dispensing cabinet.

And yet another object of this invention is to provide a dispensing cabinet that includes means for relieving the pressure on a compressed stack of paper sheets inserted into the cabinet, said pressure release means operating automatically as the cabinet is closed.

DISCLOSURE OF THE INVENTION

In accordance with this invention, there is provided a cabinet for dispensing a single sheet of paper from a stack of paper placed in the cabinet. Mounted in the cabinet is a restricting means having a first position for restricting the length of the stack of paper that can be placed in the cabinet when the cabinet is open and having a second position for providing a length greater than said restricted length when the cabinet is closed. The restricting means can be either manually or automatically moved from the restricting position to the pressure relieving position.

In one embodiment, the restricting means is pivotally mounted in the container section and gravitates to the stack length restricting position when the container section is separated from the cover section of the cabinet. After the stack of paper sheets has been loaded into the cabinet, and as the container section is moved toward the cover section, projections on the cover section intercept the restricting means and cause the restricting means to move to the pressure relieving position.

In another embodiment of the invention, the restricting means comprises a plate and at least one pair of pivotally mounted, linked locking elements. When the cabinet is empty, the linked locking elements maintain the plate at the stack length restricting position. As the cabinet is closed, a projection on the cover section causes the linked locking elements to move to a position wherein the plate is free to move in response to any forces applied to it due to decompression of the compressed stack.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
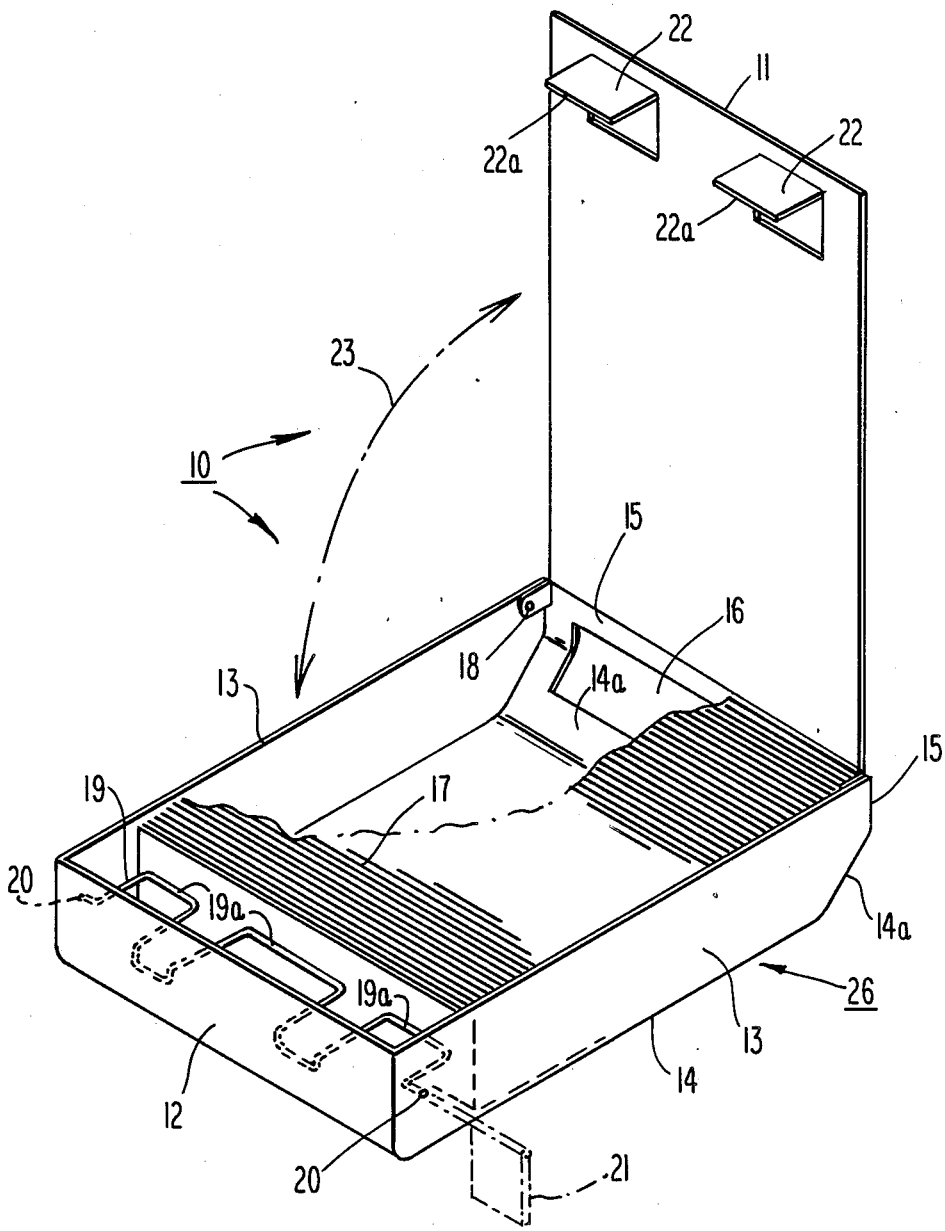
FIG. 1 is a perspective view of a dispensing cabinet of the invention with the cabinet pivoted downward from a back cover member to expose the interior.
Figure 2A:
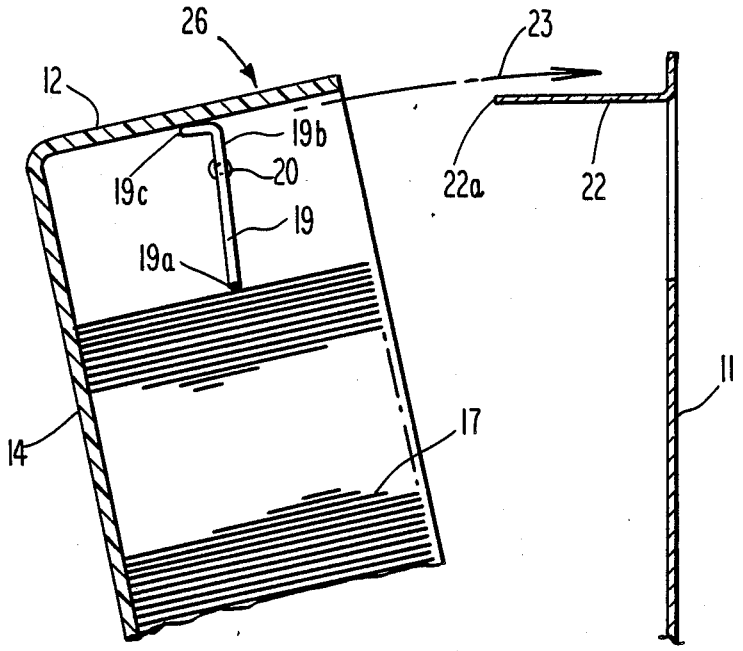
FIG. 2*a* is a partial sectional side elevation view of the dispensing cabinet of FIG. 1 illustrating the means for restricting the stack length while the dispensing cabinet is still open.
Figure 2B:
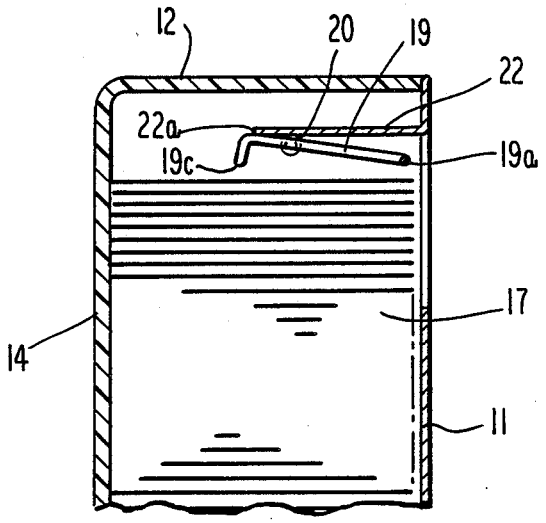
FIG. 2*b* is a partial sectional side elevation view of the cabinet of FIG. 1 illustrating the relief of pressure on the stack when the dispensing cabinet is closed.

FIGS. 1, 2A and 2B depict one embodiment of a cabinet 10 for holding and dispensing a stack 17 of paper product, which in this example is a stack 17 of folded paperr towels. The dispensing cabinet 10 comprises a rear wall 11, a top wall 12, side walls 13, front wall 14, and a bottom wall 15. A portion of bottom wall 15 and of the lowermost section 14*a* of front wall 14 have been removed to form a dispensing opening 16 through which individual paper towels can be withdrawn. The dispensing cabinet 10 is usually mounted on a wall in a washroom by means such as screws (not shown) through rear wall 11. As indicated by arrow 23, the dispensing cabinet 10 can pivot about point 18 so that the container section 26 can be rotated downward from rear wall 11 to allow a maintenance person to refill the container section 26. Mounted in the container section 26 is a pack length restricting means 19 that is pivotally mounted at points 20 in sidewalls 13. As shown in FIG. 1, restricting means 19 is shown in the stack length restricting position. In that restricting position, segments 19*a* limit the number of paper towels that can be loaded into the container section 26. Although the restricting means 19 can be manually positioned to the restricting position, by locating the pivot point 20 so that the weight of that portion of the restricting means below the pivot point 20 is heavier than the weight of that portion 19*b*, 19*c* of restricting means 19 that is above the pivot point 20, the restricting means 19 automatically gravitates to the restricting position when the container section 26 is open to the position shown in FIG. 1. The upper end 19*c* of restricting means 19 intercepts top wall 12 so that restricting means 19 does not rotate past the restricting position.

As shown in FIG. 1, a pair of projections 22 are formed at the top of rear wall 11. After the container section 26 has been refilled with a new stack 17 of paper towels, the container section 26 is rotated upwards to close the cabinet 10. As shown in FIGS. 2A and 2B, as the dispensing cabinet 10 is closed, the edges 22*a* of projections 22 intercept the restricting member 19 above the pivot point 20. As the closing of the dispensing cabinet 10 is completed, the restricting means 19 will be caused to rotate to the pressure relieving position depicted in FIG. 2B and the stack 17 is allowed to expand to relieve any undue compressive force originally exerted on the stack 17.

Althrough the projection 22 on rear wall 11 automatically caused the restricting means 19 to move to the pressure relieving position, it will be apparent to those skilled in the art that restricting means 19 could be manually placed in the pressure relieving relieving position after the cabinet 10 has been closed. For example, restricting means 19 can exend through side wall 13 and terminate in a manually operated handle (shown by dashed lines) 21. After the dispensing cabinet 10 has been closed, the operator rotates handle 21 through 90 degrees thereby placing the restricting means 19 in the pressure relieving position. By way of another example, if the cabinet has a lock, it would be a simple matter to design a key-operated linkage that moves the restricting means 19 to the pressure relieving position.

Figure 3:
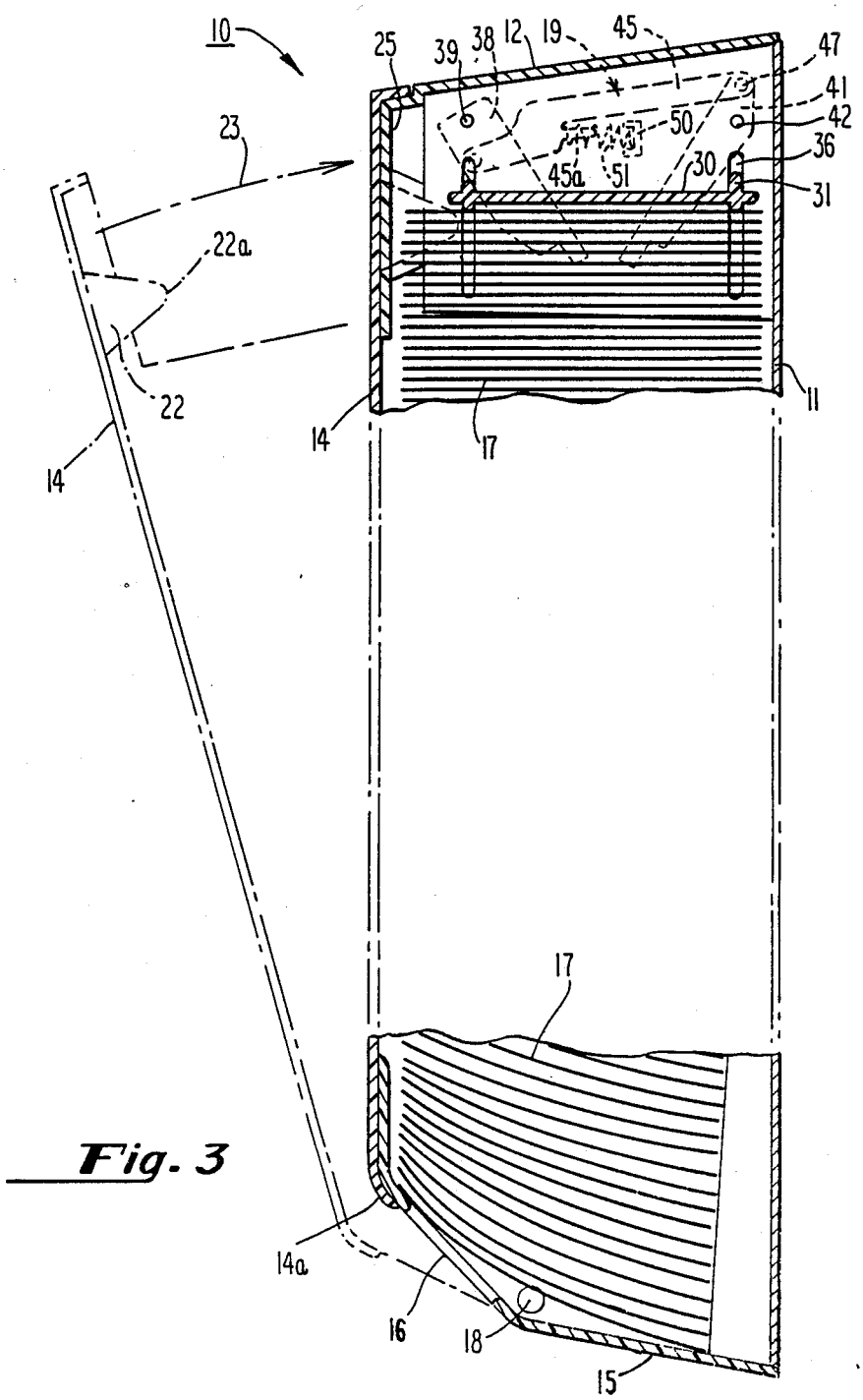
FIG. 3 is a sectional side elevation of a second embodiment of a dispensing cabinet of the invention.
Figure 4:
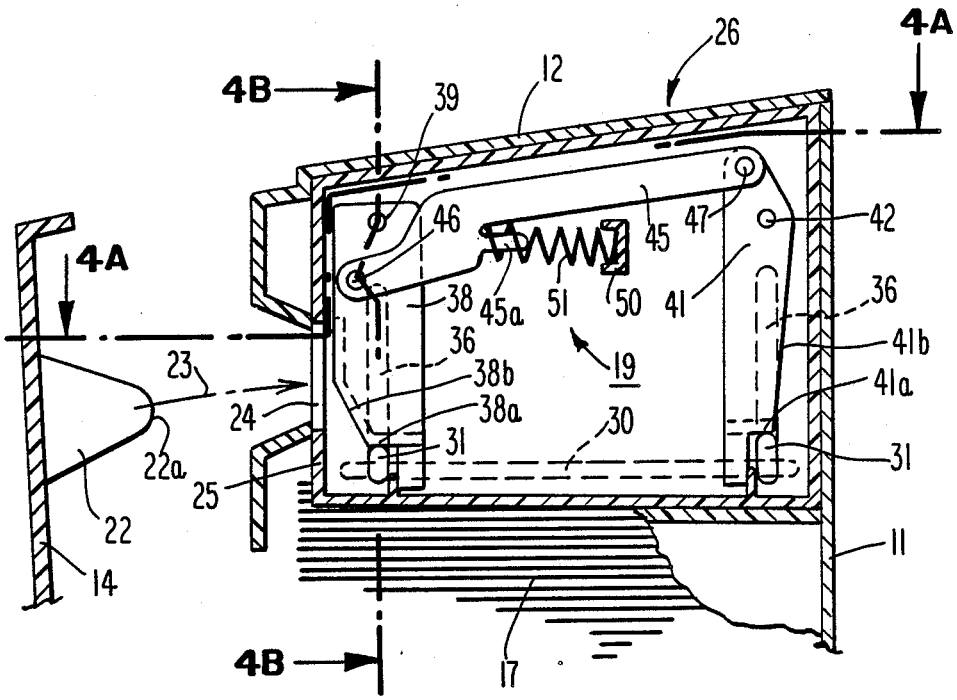
FIG. 4 is a partial sectional side elevation of the dispenser of FIG. 3 taken along the line 4—4 of FIG. 4A with the stack length restricting means in the restricting position.

Referring now to FIGS. 3–6, there is shown a preferred embodiment of our invention. For the sake of convenience, certain elements depicted in FIGS. 3–6 will retain the same element number as corresponding elements depicted in FIGS. 1–2. In FIGS. 3–6, the dispensing cabinet 10 comprises a rear wall 11, a top wall 12, two side walls 13, a front wall 14 and a bottom wall 15. This dispensing cabinet 10 is also designed to be mounted on the wall of a washroom by means of screws or other fastening means (now shown) through rear wall 11. In this preferred embodiment, the front panel 14 is a door that rotates downward about pivot point 18 to expose the container section 26 of the dispensing cabinet 10. The stack length restricting means 19 includes a plate 30 having attached to it two ribs 31, each rib extending beyond both sides of plate 30. The rib extensions 31*a* are located in vertical guide slots 36 formed in upper interior side walls 35 of the dispenser 10 which allow plate 30 to move freely up and down the length of the slots 36. When the cabinet 10 is empty, the restricting plate 30 will gravitate to the lowest position permitted by slots 36 as shown in FIG. 4. The restricting plate 30 is maintained in the stack length restricting position by means of a pair of front locking elements 38 pivotally mounted at each side of the cabinet 10 about points 39 and a pair of rear locking elements 41 pivotally mounted at each side of the cabinet 10 about points 42. The front and rear locking elements 38, 41 on one side of the cabinet 10 move in tandem because a link 45 pivotally connected to each front locking element 38 at a point 46 below pivot point 39 is also pivotally connected to a corresponding rear locking element 41 at a point 47 above pivot point 42. A compression spring 51 having one end mounted in retainer 50 and having its other end mounted over finger 45*a* extending from link 45 exerts a biasing force on link 45 which biases front locking element 38 and rear locking element 41 in the position shown in FIG. 4. In this biased position, the lower edge 38*a* of the front locking element 38 and the lower edge 41*b* of the rear locking element 41 maintain plate 30 at the stack length restricting position thereby limiting the number of towels that can be stacked in the container section 26 of dispensing cabinet 10. After the container section 26 has been refilled by placing a stack 17 of folder paper towels therein, the door 14 is rotated upward about pivot 18 as indicated in FIG. 3 by arrow 23. Just before the door 14 closes, the front edges 22*a* of projections 22 mounted at the upper end of door 14 extend into slots 24 in interior front wall 25 and make contact with the front edges 38*c* of front locking elements 38. As the door 14 continues toward the closed position indicated in FIG. 5, front locking elements 38 rotate in the counter clockwise direction about pivot points 39 as indicated by arrow 61. The counter clockwise movement of front locking elements 38 is transferred by links 45 into a clockwise movement of rear locking elements 41 about pivot point 42. As soon as locking elements 38 and 41 have rotated to the point that the lower surfaces 38*a* of front locking elements 38 and the lower surfaces 41*a* of rear locking elements 41 no longer impede the upper movement of rib extensions 31*a*, the restricting plate 30 will be free to move upward in response to any decompressive forces applied to the bottom of plate 30 by the compressed stack 17 of paper towels.

Figure 5:
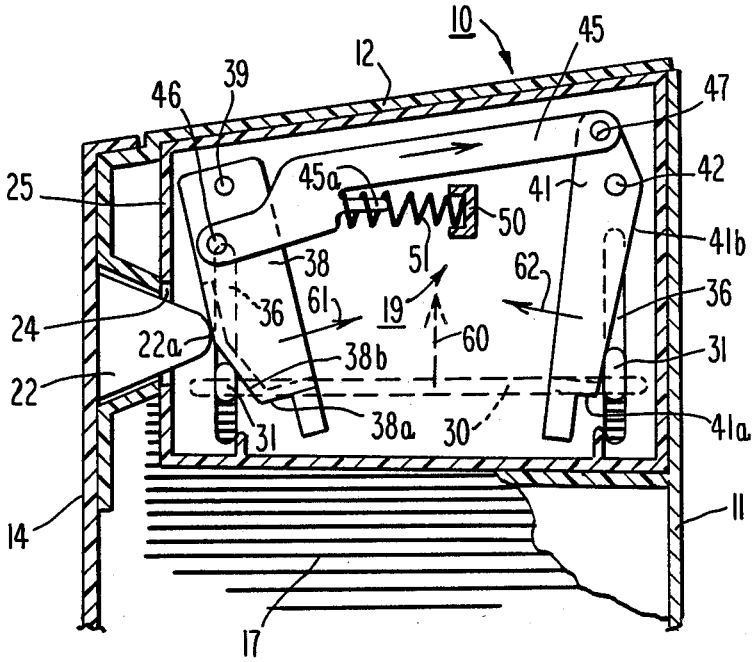
FIG. 5 is a partial sectional side view of the dispenser of FIG. 3 showing the stack length restricting means just after the stack begins to decompress.
Figure 4A:
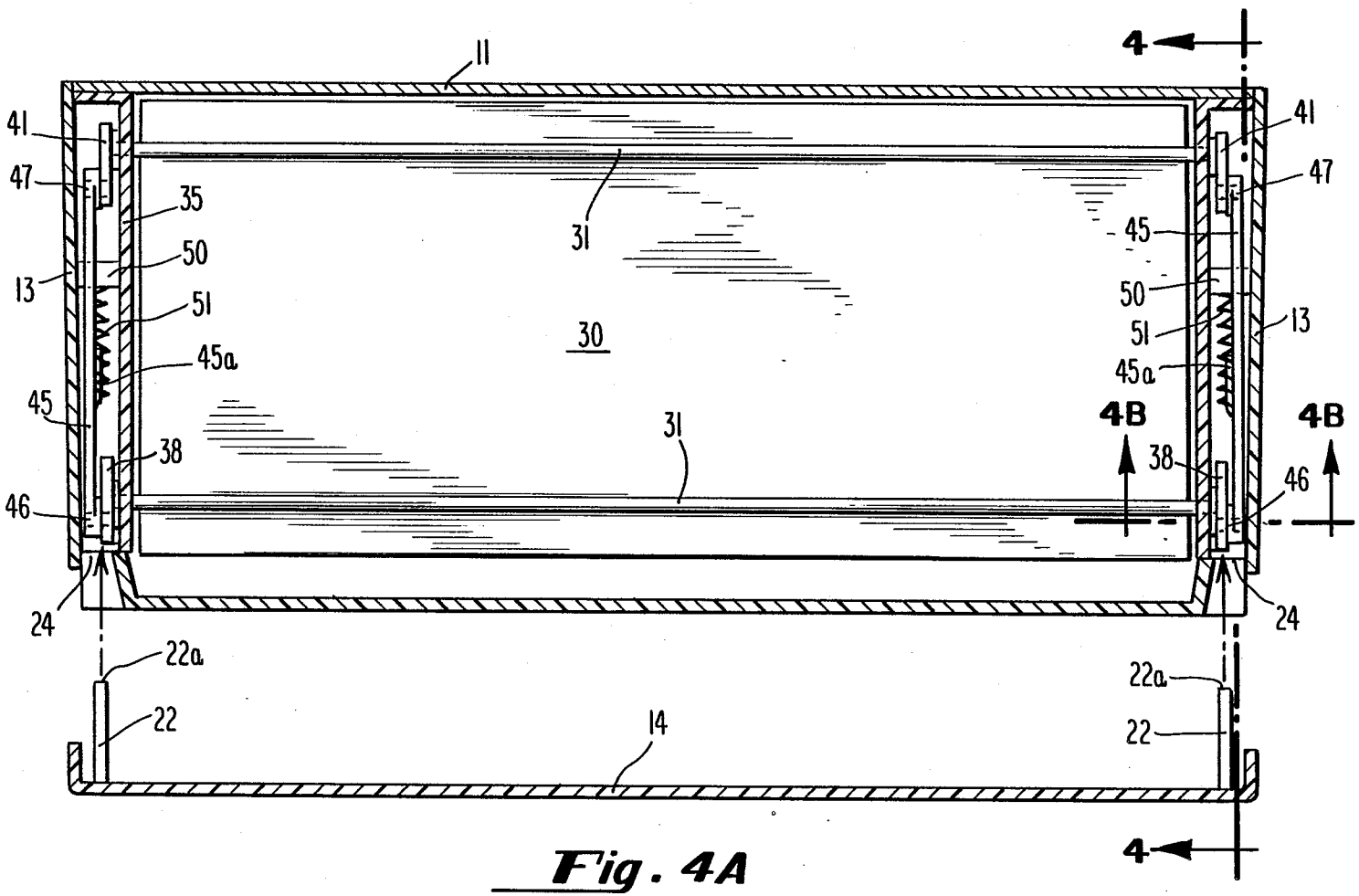
FIG. 4A is a sectional view of the cabinet of FIG. 3 taken along the line 4A—4A of FIG. 4.
Figure 6:
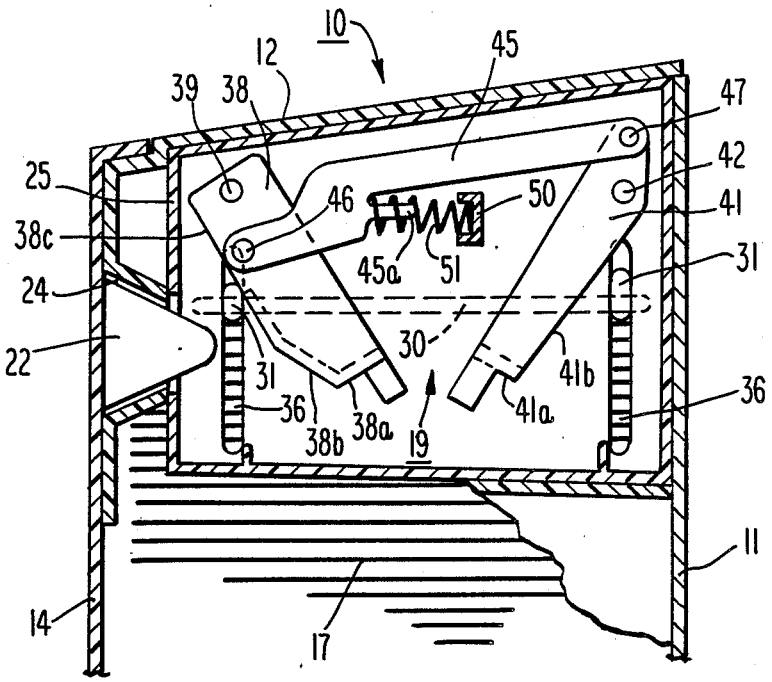
FIG. 6 is a partial sectional side view of the dispenser of FIG. 3 showing the stack length restricting means in the fully decompressed position.
Figure 4B:
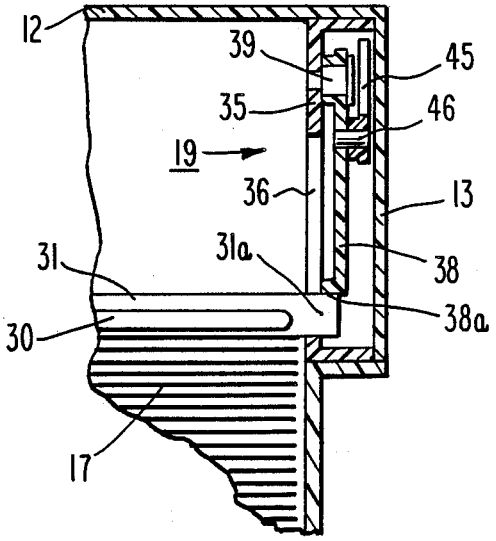
FIG. 4B is a partial sectional front elevation of the cabinet of FIG. 3 taken along the line 4B—4B of FIG. 4.

FIG. 5 shows the position of restricting plate 30, locking elements 38, links 45 and locking elements 41 when the door 14 is closed and the stack 17 is in the process of decompressing. The edges 22*a* of projections 22 are still in contact with the straight edges 38*c* of front locking elements 38. Restriction plate 30 has begun to move upward in response to the decompression force applied by the stack 17 to the underside plate 30 and has reached a position where the extended ribs 31*a* are in contact with sloped surfaces 38*b* and 41*b* of locking elements 38 and 41. If at the point depicted in FIG. 5, the plate 30 has not reached a point of equilibrium, it will continue to be displaced upward in response to a decompression force to reach a position such as that shown in FIG. 6. As can be seen in FIG. 6, as the plate 30 continues to move upward from the position depicted in FIG. 5, the continued counter clockwise rotation of front locking elements 38 is provided by rib extensions 31*a* as they contact slanted surfaces 38*b* and vertical surfaces 38*c* of front locking elements 38. Again, this further counter clockwise motion of front locking elements 38 is transferred through links 45 to cause further clockwise rotational motion of rear locking elements 41.

It will be apparent to those skilled in the art that biasing spring 51 may not be needed. When the height of the stack 17 of paper towels is below the lowest level of slots 36, it is clear that restricting plate 30 and the extended rib portions 31*a* thereof will gravitate to the bottom of slots 36. Also, the location of pivot points 39 and 42 and the shape of locking elements 38 and 41 can be designed so that the locking elements 38 and 41 also gravitate to the position illustrated FIG. 4 when restricting plate 30 is at its lowest position. However, as pivot points can become dirty or sticky, it is desirable to use a biasing spring 51 to increase the reliability of the proper positioning of locking elements 38 and 41.

While the present invention has been described with reference to specific embodiments thereof, it will be obvious to those skilled in the art that various changes and modifications may be made without departing from the invention in its broader aspects.

What is claimed as new and desired to be covered by Letters Patent of the United States is:

1. An improved cabinet for dispensing a sheet of paper from a stack of paper sheets in the cabinet, the cabinet having a dispensing opening, a refillable container section, and a cover section wherein the improvement comprises:

(a) first means, pivotally mounted in the cabinet, having a surface that pivots into contact with the stack thereby restricting the stack length when the container section is separated from the cover section, the first means being pivotable to a pressure relieving position when the container section is joined with the cover section; and (b) second means for pivoting the first means from the stack length restricting position to the pressure relieving position when the contained section is joined with the cover section, thereby reducing the pressure on the sheet adjacent the dispensing opening caused by a compression force applied to the stack by the pivoted surface.

2. The dispensing cabinet of claim 1 wherein the second means is connected to the first means and extends outside the container section whereby the surface of the first means can be manually pivoted to the pressure relieving position after the container section is covered.

3. The dispensing cabinet of claim 1 wherein the second means is mounted on the cover.

4. The dispensing cabinet of claim 3 wherein the first means pivots due to gravity to the restricting position when the container section is separated from the cover section.

5. The dispensing cabinet of claim 1 wherein the second means is mounted on the cover section so as to conduct and cause the first means to pivot to the pressure relieving position as the container section and the cover section move toward each other.

6. The dispensing cabinet of claim 1 wherein the first means pivots due to gravity to the restricting position when the container section is separated from the cover section.

7. An improved cabinet for dispensing a sheet of paper from a stack of paper sheets in the cabinet, the cabinet having a top wall and a bottom wall with a dispensing opening proximate to the bottom wall, a refillable container section and a cover section wherein the improvement comprises:

(a) a movable element located in the cabinet above the stack;

(b) locking means pivotally residing at a restricting position inhibiting movement of said movable element toward the top wall when the container section is opened from the cover section thereby limiting the stack length;

(c) means for pivoting said locking means when the container section is closed with the cover section, said means for pivoting moving said locking means from said restricting position thereby allowing said movable element to move toward said top wall and into a pressure relieving position.

8. The dispensing cabinet of claim 7 wherein the locking means comprises:

(a) a first pivotally mounted locking element adjacent the plane of the closed cover;

(b) a second pivotally mounted locking element adjacent the wall of the container section opposite the closed cover; and (c) a link connecting the first and second elements so that the first and second elements move in tandem.

9. The dispensing cabinet of claim 7 wherein the locking means comprises:

(a) a first pivotally mounted element;

(b) a second pivotally mounted element spaced from the first pivotally mounted element; and (c) a link connecting the first and second elements so that the first and second elements move in tandem.

10. The dispensing cabinet of claim 7 wherein the movable element is a plate and the locking means comprises:

(a) a first pair of pivotally mounted locking elements each mounted adjacent to a container section side wall and adjacent the plane of the closed cover;

(b) a second pair of pivotally mounted locking elements each mounted adjacent a container section side wall and adjacent the wall of the container section opposite the plane of the closed cover; and (c) a pair of links each connecting one of the first pair of locking elements with the opposed one of the second pair of locking elements so that the connected locking elements move in tandem.

11. The dispensing cabinet of claim 10 further comprising means connected to one linked pair of locking elements for biasing the locking elements in a plate restricting position when the cover section is separated from container section.

* * * * *